US006563901B2

(12) United States Patent
Wooldridge

(10) Patent No.: US 6,563,901 B2
(45) Date of Patent: May 13, 2003

(54) MULTI-HEAD COUNTING SYSTEM WITH SIZE DISCRIMINATION

(76) Inventor: Donald R. Wooldridge, 2360 Shields Dr., Dunkirk, MD (US) 20754

( * ) Notice: Subject to any disclaimer, the term of this patent is extended or adjusted under 35 U.S.C. 154(b) by 0 days.

(21) Appl. No.: 09/970,658

(22) Filed: Oct. 5, 2001

(65) Prior Publication Data

US 2003/0068004 A1 Apr. 10, 2003

(51) Int. Cl.[7] ..... G06M 11/04

(52) U.S. Cl. ..... 377/11; 377/6; 377/10; 209/551

(58) Field of Search ..... 377/6, 10, 11; 209/551

(56) References Cited

U.S. PATENT DOCUMENTS 5,157,899 A * 10/1992 Tas ..... 53/399
5,313,508 A 5/1994 Ditman et al. ..... 377/6
5,454,016 A 9/1995 Holmes ..... 377/6
5,804,772 A 9/1998 Wooldridge et al. ..... 177/116
6,273,238 B1 8/2001 Wooldridge ..... 198/459.8

* cited by examiner

*Primary Examiner*—Margaret R. Wambach
(74) *Attorney, Agent, or Firm*—Crowell & Moring LLP

(57) ABSTRACT

A counter unit counts discrete articles that are within a predetermined size range into lots having a predetermined number of articles. The counter unit includes (1) a first conveyor that delivers a flow of articles separated at discrete intervals; and (2) at least one bin positioned to receive articles from the conveyor. The at least one bin has at least first and second outlet gates for emptying articles into separate respective first and second locations. A detector unit detects and maintains a count of articles that are received in the at least one bin and fall within said predetermined size range. The detector unit generates an out-of-size signal when an article received in the at least one bin falls outside said predetermined size range. A control unit causes the first outlet gate to open when the count of articles is equal to said predetermined number and causes the second outlet gate to open in response to receipt of an out-of-size signal.

28 Claims, 8 Drawing Sheets

MULTI-HEAD COUNTING SYSTEM WITH SIZE DISCRIMINATION

BACKGROUND OF THE INVENTION

The present invention is directed to a method of and an apparatus for detecting and counting articles that are within a predetermined size range into lots having a specific number of articles. The lots are collected in at least one bin having at least a first outlet gate and a second outlet gate. A control unit causes a first outlet gate to open when the count of articles having the predetermined size is equal to the predetermined number. A detector unit generates an out-of-size signal when an article falls outside of the predetermined size range. In response to the out-of-size signal, the control unit causes a second outlet gate to open, thereby rejecting the articles in the at least one bin. In addition, the methods and apparatus of the present invention may detect and count articles having a predetermined color into lots having a specific number of colored articles. For convenience, the following discussion will be directed only to counting articles having a predetermined size.

Devices for counting or aggregating articles are known. For example, U.S. Pat. No. 5,454,016, which is incorporated herein by reference in its entirety, discloses a method and apparatus for counting irregularly shaped articles. A pair of alternately energized light sources is provided at a sensing plane through which articles to be counted pass. Each of the light sources emits a light beam that is at an angle to the other light beam, such as an angle of about 90°.

U.S. Pat. No. 5,804,772, which is incorporated herein by reference in its entirety, discloses an apparatus and method for aggregating a desired number of articles without individually counting out each article to achieve the desired number. A stream of the articles is discharged into a weigh hopper until.substantially a predetermined weight of articles is in the hopper. The number of articles in the hopper is determined from the total weight of the hopper and the weight of a single article.

However, known devices do not detect and package a lot of articles having a predetermined count and a predetermined size and reject lots having articles falling outside the predetermined size range.

It is an object of the present invention to overcome the deficiencies of the known devices and methods and to provide an apparatus and method for detecting and counting articles that accurately counts a predetermined number of discrete articles that are within a predetermined size range.

It is another object of the present invention to provide an article.detecting and counting apparatus that is relatively simple and inexpensive to manufacture and to maintain and that is both accurate and reliable.

SUMMARY OF THE INVENTION

In accordance with one aspect of the present invention, a counter unit for counting discrete articles within a predetermined size range into lots having a predetermined number of articles includes (1) a first conveyor that delivers a flow of articles separated at intervals, and (2) at least one bin positioned to receive articles from the conveyor. The at least one bin may have first and second outlet gates for emptying the articles into first and second separate locations. A detector unit counts the articles that are received from the conveyor into the at least one bin and which fall within the predetermined size range. A control unit causes the first outlet gate to open when the count of articles is equal to the predetermined number of articles. However, when an article falls outside the predetermined size range, the detector generates an out-of-size signal. The control unit, upon receipt of the out-of-size signal from the detector unit, causes the second outlet gate to open, thereby rejecting the articles. The counter unit may also be used to for counting articles having a predetermined color into lots having a predetermined number of articles. When an article does not have the redetermined color, the detector generates an out-of-color signal. The control unit, upon receipt of the out-of-color signal from the detector unit, causes the second outlet gate to open thereby rejecting the articles.

Other objects, advantages and novel features of the present invention will become apparent from the following detailed description of the invention when considered in conjunction with the accompanying drawings.

DETAILED DESCRIPTION OF THE DRAWINGS

Figure 1:
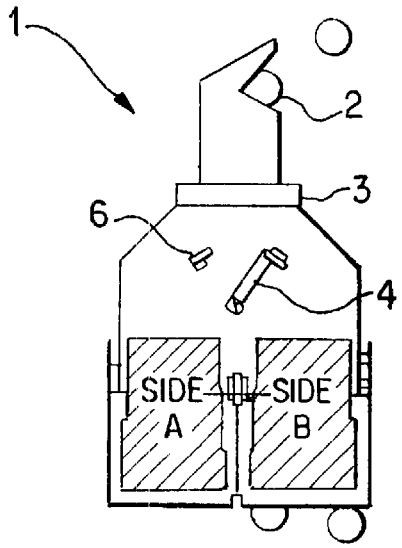
FIG. 1 is an external view of a counter unit according to the present invention containing two bins (Side A and Side B)

FIG. 1 is an external view of a counter unit 1 according to the present invention for counting discrete articles that are within a predetermined size range into lots having a predetermined number of articles. The counter unit includes an opening 2 to receive a flow of articles, at least one detector unit 3, and one or more bins for receiving articles (Side A and Side B). An indicator 4, which shows the position of a deflector gate 5 inside the counter unit, is located on the outside between one or more sensors 6.

The detector unit 3, which detects and maintains a count of articles, is located above the bins. The detector unit generates an out-of-size signal when an article falls outside a predetermined size range. The detector unit may be an optical sensor or recognition system, for example, as shown in U.S. Pat. No. 5,454,016, which is incorporated by reference in its entirety. The deflector gate 5 is disposed in the flow of articles and selectively diverts the flow to a specific bin, for example, Side A or Side B.

Figure 1A:
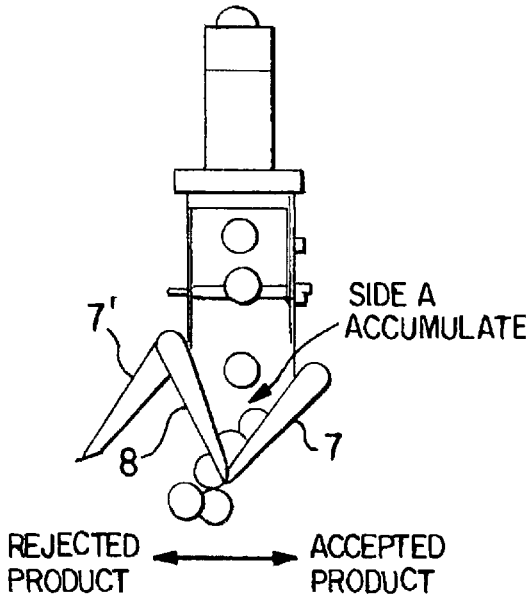
FIG. 1*a* is a side view (Side A) of the counter unit in FIG. 1.
Figure 1B:
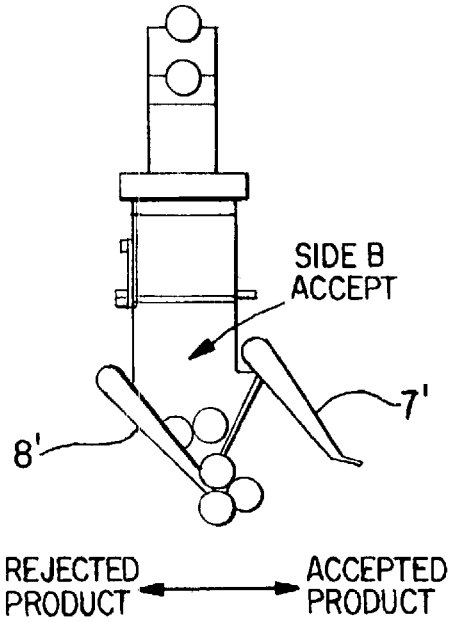
FIG. 1*b* is a side view (Side B) of the counter unit shown in FIG. 1.
Figure 1C:
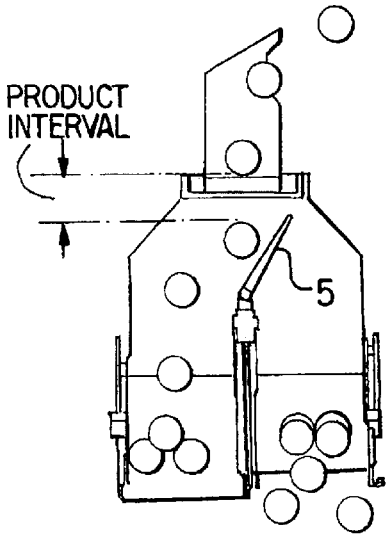
FIG. 1*c* is a cut-away view of a counter unit shown in FIG. 1.

FIG. 1*a* shows a side view the counter unit corresponding to one bin, Side A. The flow of articles is accumulated in Side A. A first outlet gate 7 and a second outlet gate 8 of Side A are closed. FIG. 1*b* shows a side view of the other bin, Side B. A counted lot of articles having the predetermined size is accepted, and discharged by opening a first outlet gate 7'. The second outlet gate 8' remains closed. FIG. 1*c* shows deflector gate 5, which allows a flow of articles in Side A, while Side B is opened and the counted lot is discharged.

Figure 2:
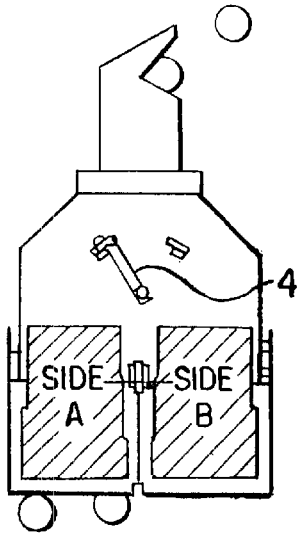
FIG. 2 is an external view of a counter unit according to the present invention containing two bins (Side A and Side B)

FIG. 2 shows the alternate functioning of the counter unit of FIG. 1 in which a situation in which the detector unit 3 detects an out-of-size article. FIG. 2 is the same counter unit as in FIG. 1, but the deflector gate 5 is in a different position as shown by indicator 4.

Figure 2A:
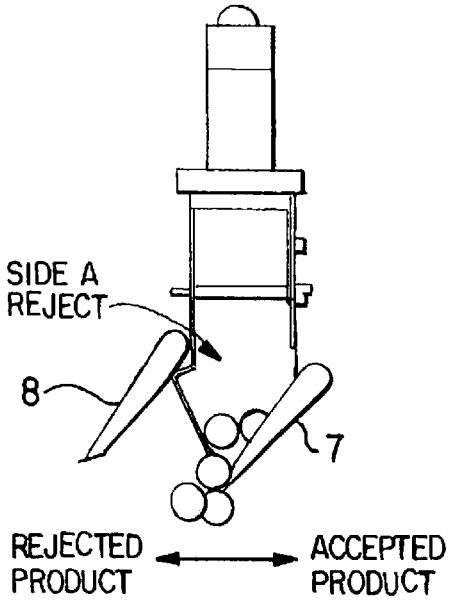
FIG. 2*a* is a side view (Side A) of the counter unit in FIG. 2.
Figure 2B:
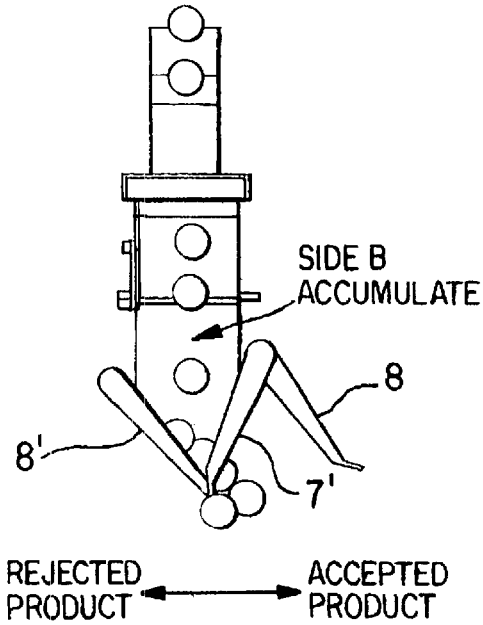
FIG. 2*b* is a side view (Side B) of the counter unit shown in FIG. 2.
Figure 2C:
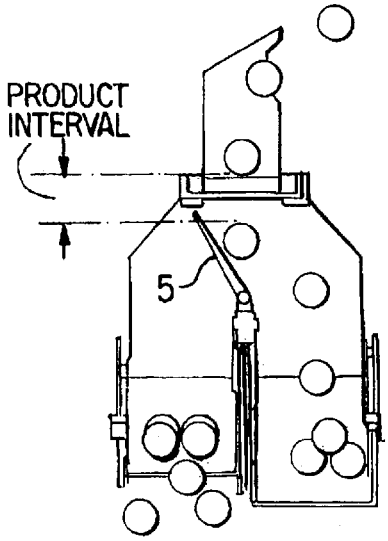
FIG. 2*c* is a cut-away view of a counter unit shown in FIG. 2.

FIG. 2*a* shows a side view of the counter unit corresponding to one bin, Side A. Articles are discharged from Side A upon receipt of an out-of-size signal from the detector unit 3. Consequently, the second outlet gate 8 is opened. FIG. 2*c* shows a side view of the counter unit corresponding to bin Side B in which a counted lot of a predetermined size,is accumulated. The first and second outlet gates (7', 8') are closed. FIG. 2*d* shows deflector gate 5, which allows a flow of articles in Side B, while the rejected articles in Side A are discharged.

Figure 7:
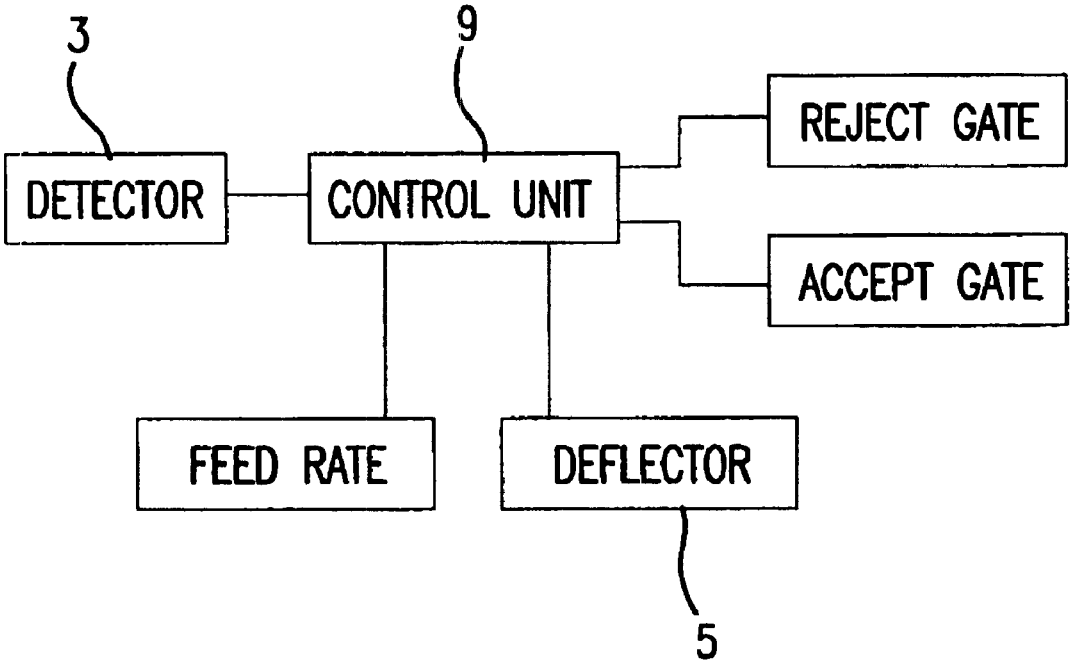
FIG. 7 is a schematic diagram of a counter unit assembly according to the present invention.

A control unit 9, shown in FIG. 7, causes the first outlet gate (7, 7') to open when the count of articles is equal to the predetermined number. The control unit causes the second outlet!gate (8, 8') to open in response to receipt of an out-of-size signal from the detector unit 3.

The control unit 9 causes the deflector gate 5 to divert the flow of articles from one of the bins to the other when a bin has received a complete lot comprising the predetermined number of articles. The control unit determines a time required for movement of the deflector gate 5 between first and second positions. For this purpose, proximity sensors 6, which may be of any well known type, are provided on indicator arm 4 which corresponds to the position of the deflector gate 5.

In addition, the control unit 9 determines a separation interval between the articles in the flow based on signals from the detector unit. Accordingly, the control unit adjusts a flow rate of articles based on the separation interval and the time required for movement of the deflector gate.

Figure 3:
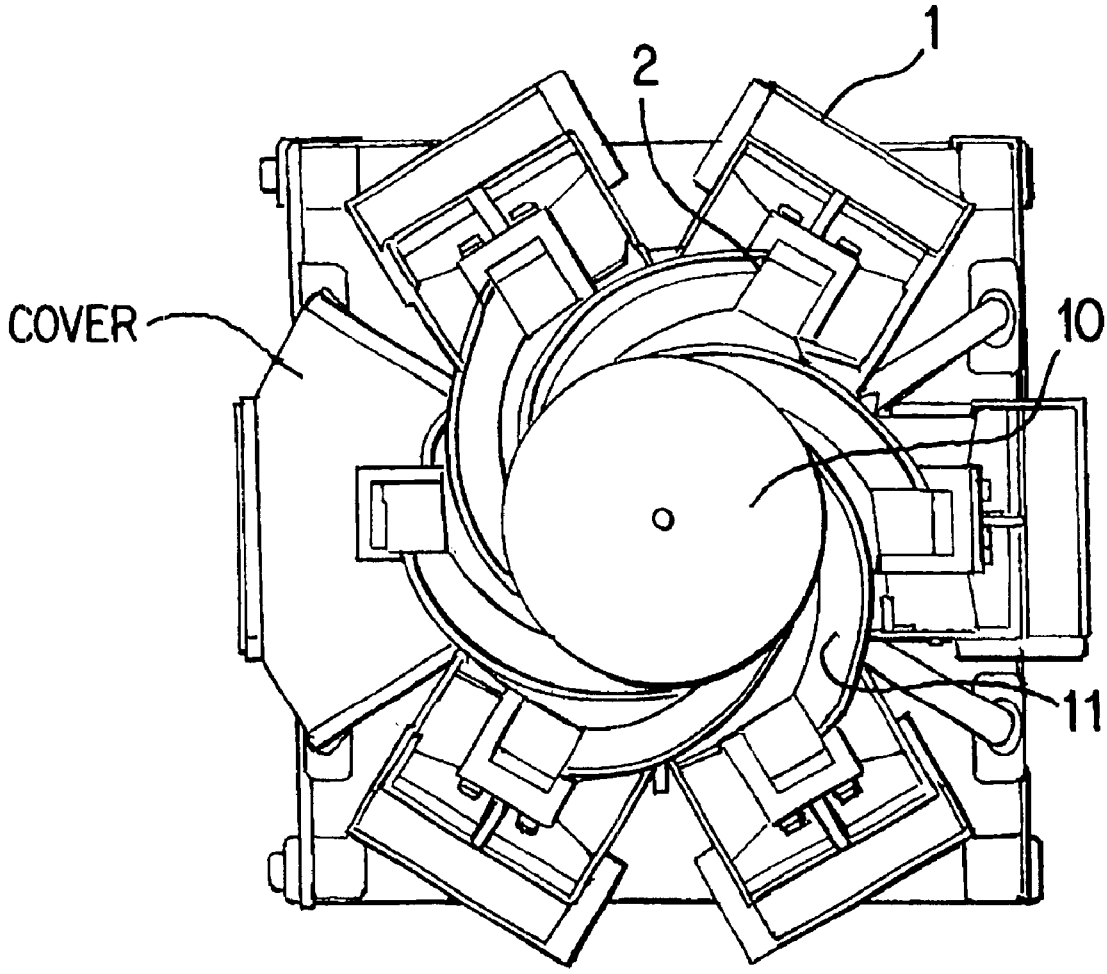
FIG. 3 is a top view of a hopper for a counter unit according to the present invention.
Figure 4B:
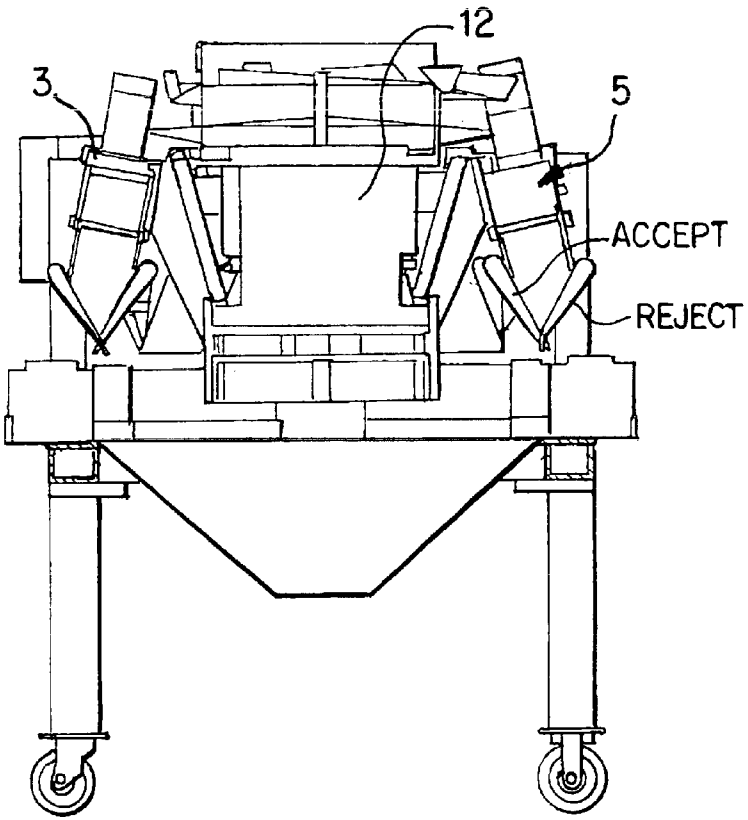
FIG. 4*b* is an external side view of a counter unit assembly as shown in FIG. 4*a* along the A—A line.

FIG. 3 is a top view of a first conveyor that brings a flow of articles to one or more counter units according to the present invention. The first conveyor may comprises a hopper 10 for receiving bulk quantities of articles to be counted and a plurality of chutes 11 for delivering a flow of articles to a plurality of counter units 1. The plurality of bins may be disposed about a periphery of the hopper, with one chute associated with each respective counter unit. Such a hopper is disclosed in U.S. Pat. No. 5,804,772, which is: incorporated by reference in its entirety. The counter unit assembly may also include a vibrator 12 in order to facilitate movement of the articles through the hopper and into chutes 11 (FIG. 4*b*). The conveyor may be slowed down or speeded up as needed.

Figure 4A:
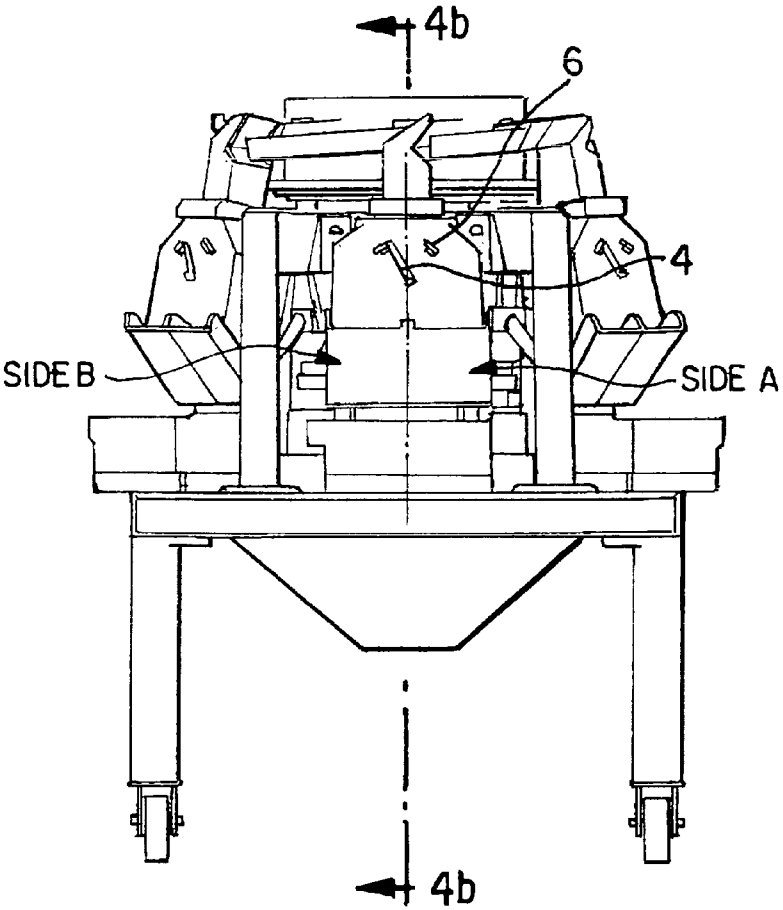
FIG. 4*a* is an external side view of a counter unit assembly according to the present invention.

FIG. 4*a* is an external view of a counter unit assembly according to the present invention. The deflector gate indicator 4, sensors 6, and bins (Side A and Side B) are illustrated. FIG. 4*b* shows the detector 5, the first outlet gates 7, 7' (e.g., accept), and the second outlet gates 8, 8' (e.g., reject).

Figure 5:
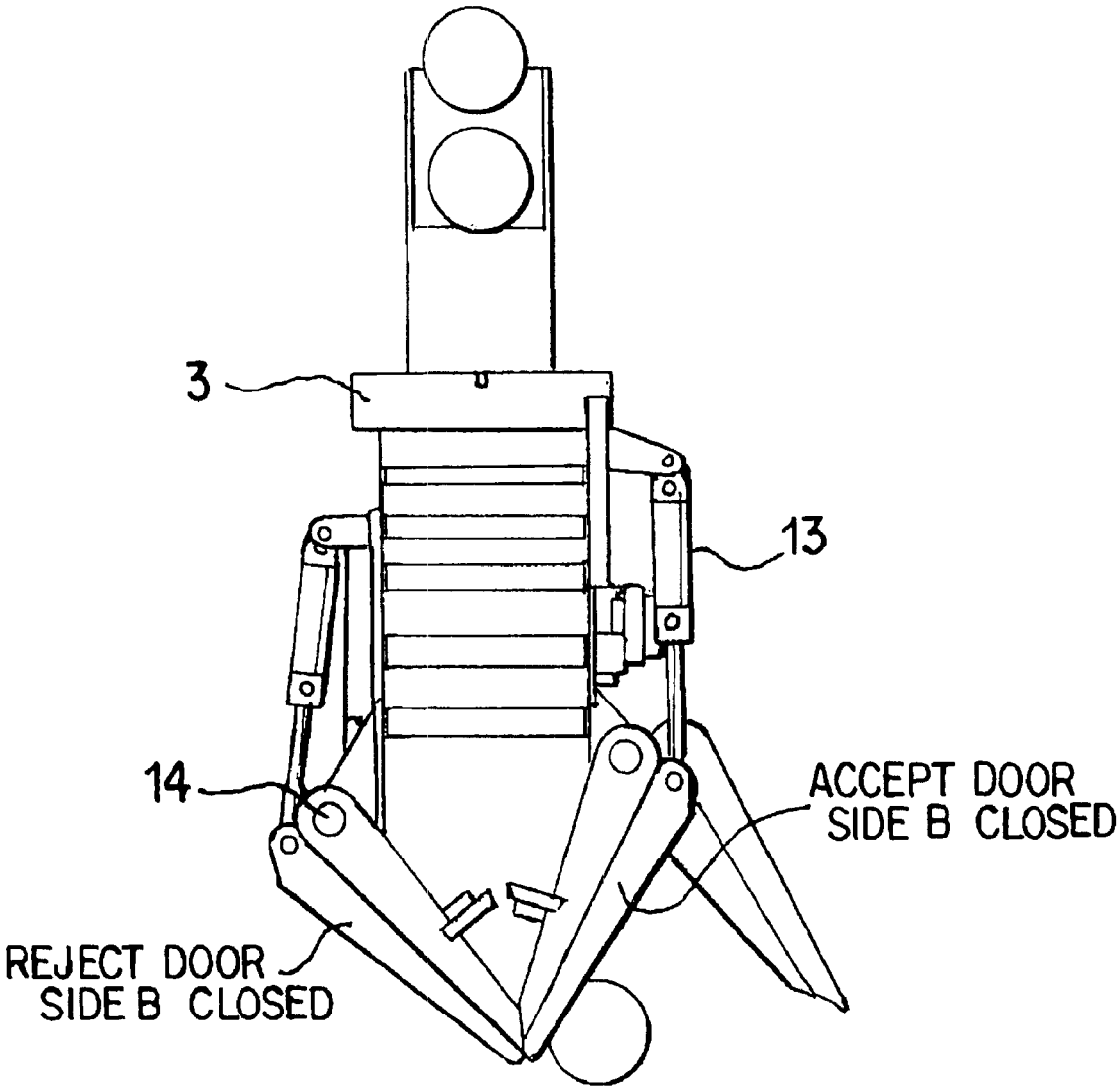
FIG. 5 is a side view of a counter unit according to the present invention.

The first outlet gates (7, 7') and second outlet gates (8, 8') may be operated by actuators, such as for example hydraulic or pneumatic cylinders 13 and hinges 14 as shown in FIG. 5. Alternatively, other types of actuators may be used, such as electrically energized solenoids or the like.

According to the method of the present invention, a flow of articles separated by discrete intervals is provided to at least one bin positioned to receive the articles. Using the detector unit 5, a count of articles that are received in the at least one bin and fall within a predetermined size range and/or have a predetermined color is calculated. The at least one bin is emptied into a first location when the count maintained by the detector is equal to the predetermined number. However, when articles in the flow that fall outside the predetermined size range, an out-of-size signal is generated. The at least one bin is emptied into a second location in response to the generation of an out-of-size signal.

In an embodiment of the present invention, the first location may be, for example, a package for receiving one lot of articles having the predetermined size range. The package may be situated on a second conveyor that moves packages sequentially into the first location. The second location may be, for example, a container for receiving and storing groups of articles that include articles that fall outside the predetermined size range. In another embodiment of the present invention, a plurality of lots having the predetermined size range are combined.

Figure 6A:
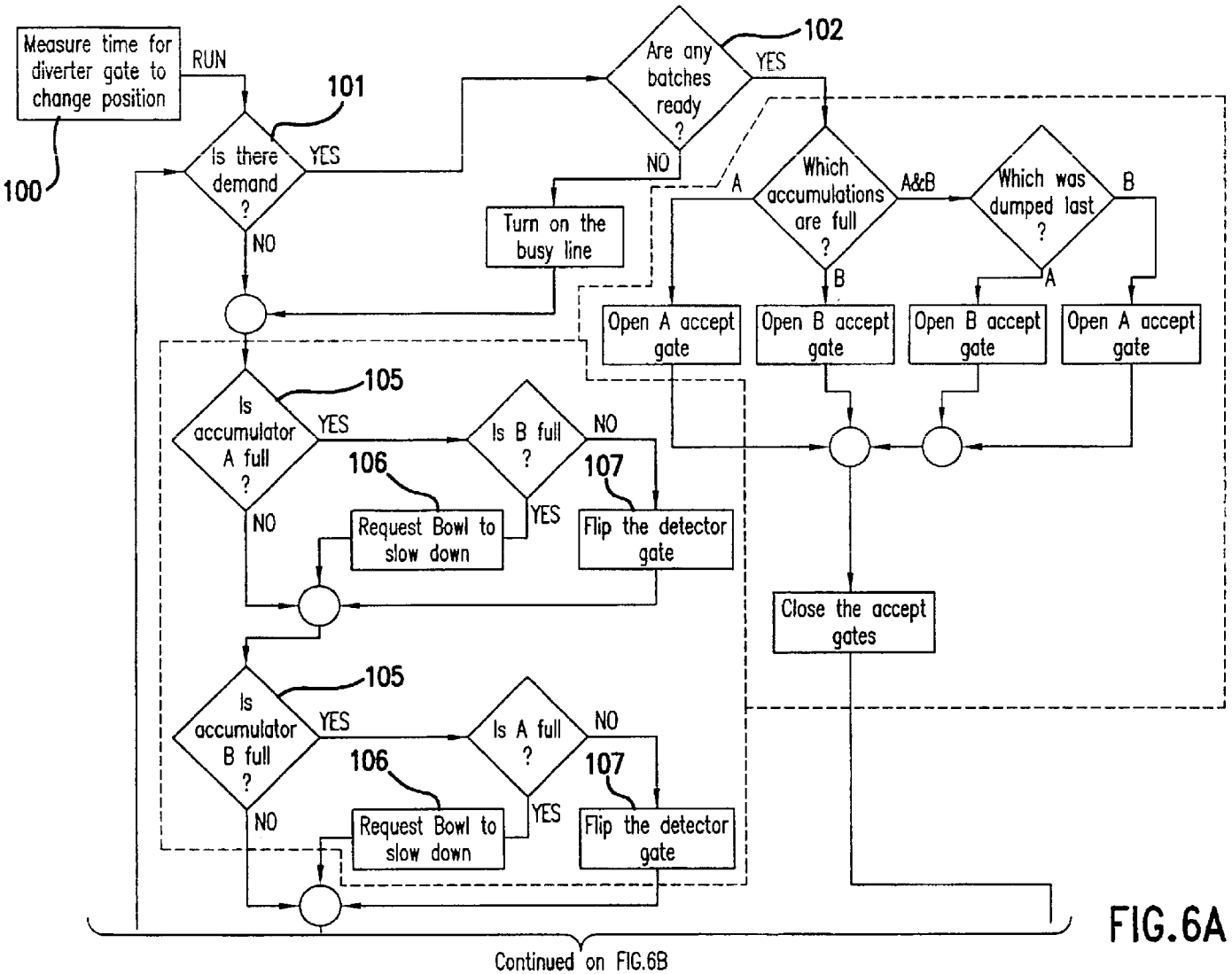
FIG. 6 is a flow chart diagram of a method for detecting and counting articles that are within a predetermined size range into lots according to the present invention.
Figure 6B:
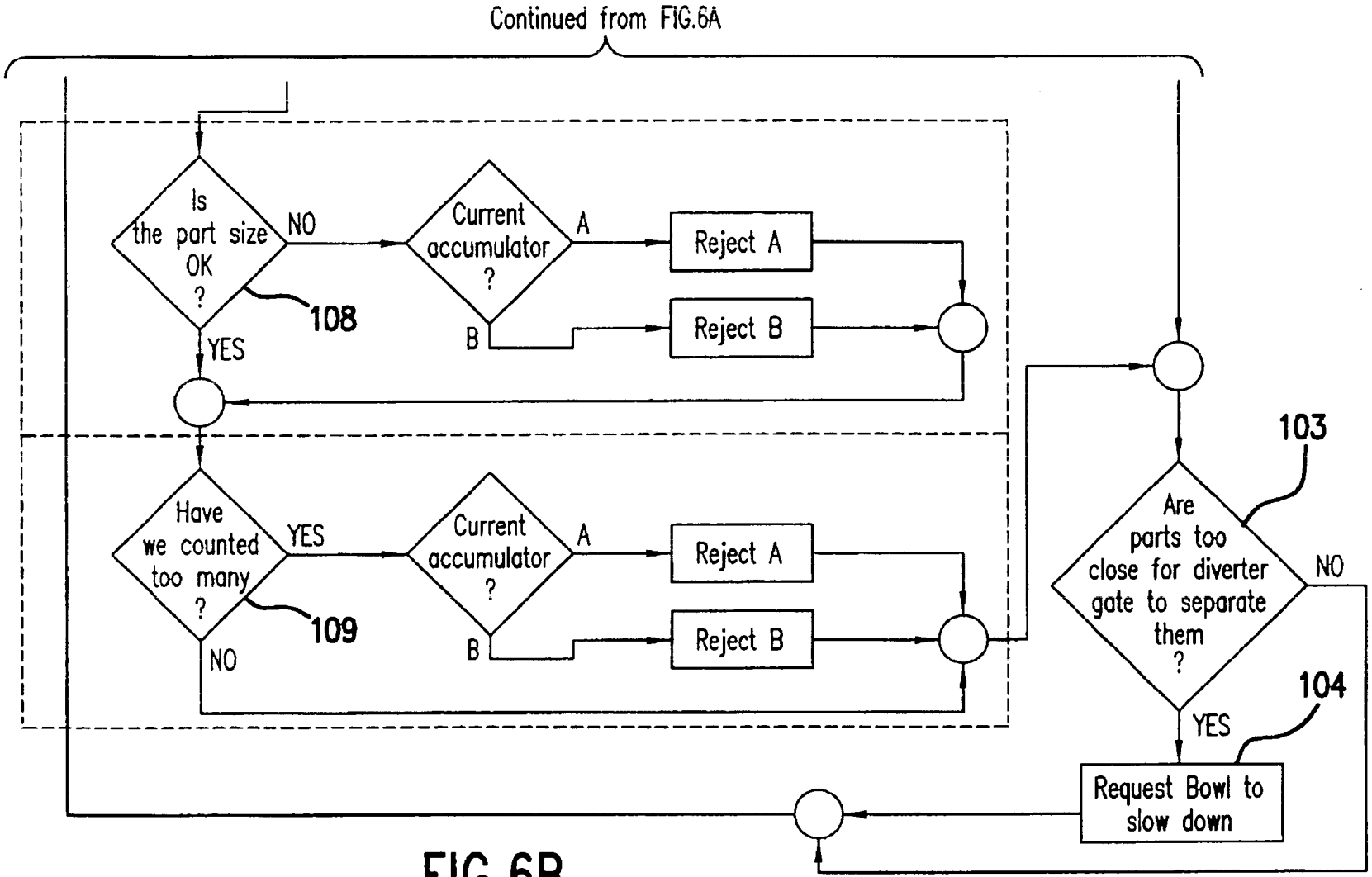

FIG. 6 shows a flow diagram for operating a method according to one embodiment of the present invention.

The time for changing the deflector or diverter gate is first measured (100). Then, in step 101, it is determined whether there is a demand (i.e., whether there is a first location capable of accepting the counted articles, such as a package in which a preset number of articles are to be filled).

If there is a demand, the counter unit determines whether any lots are ready for packaging (102). Depending on which bin or bins (A or B) may be full, the corresponding accept gates are opened and then closed.

If the flow of articles is too fast for the deflector gate to separate them, as determined in step 103, the conveyor is slowed down, thereby slowing the flow of articles to the counter unit (104).

If the first location is not ready, a determination is made as to whether existing bins (A and/or B) are full (105). If both bins are full, the conveyor is slowed down (106). However, if only one bin is full, the deflector gate is switched so that the flow of articles may continue into another bin (107).

If an out-of-size article is detected, the bin containing the lot with the out-of-size article is rejected, and the bin is emptied (108). If the articles fall with the predetermined size range but are more than the predetermined number of articles, the lot is rejected and the bin is emptied (109).

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within scope of the present invention.

What is claimed is:

1. A counter unit for counting discrete articles which are within a predetermined size range, into lots having a predetermined number of articles, said counter unit comprising:

a first conveyor which delivers a flow a articles separated at discrete intervals within said flow;

at least one bin positioned to receive articles from said flow of articles delivered by said conveyor, said at least one bin having at least first and second outlet gates for emptying articles from said at least one bin, into respective first and second locations which are separated from each other;

a detector unit which detects and maintains a count of articles that are received in said at least one bin and fall within said predetermined size range, which detector generates an out-of-size signal when an article received in said at least one bin falls outside said predetermined size range; and a control unit which causes said first outlet gate to open when the count of articles is equal to said predetermined number, and causes said second outlet gate to open in response to receipt of an out-of-size signal from said counter unit.

2. A counter unit according to claim 1, wherein:

said first location comprises a package for receiving one lot of said articles; and said second location comprises a container for receiving and storing groups of articles which include articles that fall outside the predetermined size range.

3. A counter unit according to claim 2, wherein said package is situated on a second conveyor which moves packages sequentially into said first location.

4. A counter unit according to claim 1, comprising:

first and second bins; and a deflector gate disposed in said flow of articles, for selectively diverting said flow to one of said first and second bins;

wherein said control unit causes said deflector gate to divert the flow of articles from one of said bins to the other when the one said bin has received a complete lot comprising the predetermined number of said articles.

5. A counter unit according to claim 4, further comprising a sensor arrangement for detecting presence of said deflector gate in a first position for diverting said flow of articles into said first bin and presence of said deflector in a second position for diverting said flow of articles into said second bin, wherein said control unit:

determines a separation interval between said articles in said flow based or signals from said detector unit;

determines a time required for movement of said deflector gate between said first and second positions; and adjusts a flow rate of articles in said flow based on said determined separation interval and said determined time required for movement of the deflector gate.

6. A counter unit according to claim 3, wherein said first conveyor comprises:

a hopper for receiving bulk quantities of articles to be counted; and at least one chute for delivering said flow of articles to said at least one bin.

7. A counter unit according to claim 6, comprising a plurality of bins disposed about a periphery of said hopper, with one chute associated with each respective bin.

8. A counter unit for counting discrete articles which have a predetermined color, into lots having a predetermined number of articles, said counter unit comprising:

a first conveyor which delivers a flow a articles separated at discrete intervals within said flow;

at least one bin positioned to receive articles from said flow of articles delivered by said conveyor, said at least one bin having at least first and second outlet gates for emptying articles from said at least one bin, into respective first and second locations which are separated from each other;

a detector unit which detects and maintains a count of articles that are received in said at least one bin and have said predetermined color, which detector generates an out-of-color signal when an article received in said at least one bin does not have said predetermined color; and a control unit which causes said first outlet gate to open when the count of articles is equal to said predetermined number, and causes said second outlet gate to open in response to receipt of an out-of-color signal from said counter unit.

9. An apparatus for counting discrete articles which are within a predetermined size range, into lots having a predetermined number of articles, said apparatus comprising:

a hopper for receiving bulk quantities of articles to be counted;

a plurality of counter units positioned about a periphery of said hopper; and a plurality of chutes for delivering to each of said counter units a flow of articles from said hopper, separated at discrete intervals within said flow;

wherein each of said counter units comprises, at least one bin positioned to receive articles from said flow of articles delivered by said conveyor, said at least one bin having at least first and second outlet gates for emptying articles from said at least one bin, into respective first and second locations which are separated from each other;

a detector unit which detects and maintains a count of articles that are received in said at least one bin and fall within said predetermined size range, which detector generates an out-of-size signal when an article received in said at least one bin falls outside said predetermined size range; and a control unit which causes said first outlet gate to open when the count of articles is equal to said predetermined number, and causes said second outlet gate to open in response to receipt of an out-of-size signal from said counter unit.

10. An apparatus according to claim 9, wherein:

said first location comprises a package for receiving one lot of said articles; and said second location comprises a container for receiving and storing groups of articles which include articles that fall outside the predetermined size range.

11. An apparatus according to claim 10, wherein said package is situated on a second conveyor which moves packages sequentially into said first location.

12. An apparatus according to claim 9, wherein each of said counter units comprises:

first and second bins; and a deflector gate disposed in said flow of articles, for selectively diverting said flow to one of said first and second bins;

wherein said control unit causes said deflector gate to divert the flow of articles from one of said bins to the other when the one said been has received a complete lot comprising the predetermined number of said articles.

13. An apparatus according to claim 12, wherein:

each of said counter units further comprises a sensor arrangement for detecting presence of said deflector gate in a first position for diverting said flow of articles into said first bin and presence of said deflector in a second position for diverting said flow of articles into said second bin;

said control unit determines a separation interval between said articles in said flow based or signals from said detector unit;

said control unit determines a time required for movement of said deflector gate between said first and second positions; and said control unit adjusts a flow rate of articles in said flow based on said determined separation interval and said determined time required for movement of the deflector gate.

14. An apparatus according to claim 9, wherein said first conveyor comprises:

a hopper for receiving bulk quantities of articles to be counted; and at least one chute for delivering said flow of articles to said at least one bin.

15. An apparatus according to claim 13, wherein said control unit adjusts the flow rate of articles in the flow based on a longest determined time required for movement of the deflector gate among all of said plurality of counter units.

16. A method for counting discrete articles which are within a predetermined size range, into lots having a predetermined number of articles, said method comprising:

delivering a flow of articles separated by discrete intervals within said flow;

providing at least one bin positioned to receive articles from said flow;

detecting and maintaining a count of articles that are received in said at least one bin and fall within said predetermined size range;

detecting outsized articles in said flow, which fall outside said predetermined size range, and generating an out-of-size signal when an outsized article is received in said at least one bin;

emptying said at least one bin into a first location when the count maintained in said detector is equal to said predetermined number; and emptying said at least one bin into a second location in response to generation of an out-of-size signal.

17. A method according to claim 16, wherein:

said first location comprises a package for receiving one lot of said articles; and said second location comprises a container for receiving and storing groups: of articles which include articles that fall outside the predetermined size range.

18. A method according to claim 17, wherein said package is situated on a second conveyor which moves packages sequentially into said first location.

19. A method according to claim 16, wherein said at least one bin comprises first and second bins; said method further comprising:

selectively diverting said flow of articles to one of said first and second bins; and changing the flow of articles from one of said bins to the other when the one said bin has received a complete lot comprising the predetermined number of articles.

20. A method according to claim 19, further comprising:

determining a separation interval between said articles in said flow;

determining a time required to change the flow of articles from one of said bins to the other;

adjusting a flow rate of articles in said flow, based on said determined separation interval and said determined time required to change the flow of articles.

21. A method according to claim 16, further comprising combining a plurality of lots from at least one of said first location or said second location.

22. A method for counting discrete articles which are within a predetermined size range, into lots having a predetermined number of articles, said method comprising:

delivering a flow of articles, separated by discrete intervals, into at least one bin;

counting said articles as they are received into said at least one bin;

detecting size of each of said articles as it is received into said at least one bin;

emptying said at least one bin into a first location when a count of articles in said at least one bin reaches said predetermined number; and emptying said at least one bin into a second location when a part received therein falls outside said predetermined size range.

23. A method according to claim 22, wherein:

said first location comprises a package for receiving one lot of said articles; and said second location comprises a container for receiving and storing groups of articles which include articles that fall outside the predetermined size range.

24. A method according to claim 23, wherein said package is situated on a second conveyor which moves packages sequentially into said second location.

25. A method according to claim 22, wherein said at least one bin comprises first and second bins; said method further comprising:

selectively diverting said flow of articles to one of said first and second bins; and changing the flow of articles from one of said bins to the other when the one said bin has received a complete lot comprising the predetermined number of articles.

26. A method according to claim 25, further comprising:

determining a separation interval between said articles in said flow;

determining a time required to change the flow of articles from one of said bins to the other;

adjusting a flow rate of articles in said flow, based on said determined separation interval and said determined time required to change the flow of articles.

27. A method for counting discrete articles having a predetermined color, into lots having a predetermined number of articles, said method comprising:

delivering a flow of articles separated by discrete intervals within said flow;

providing at least one bin positioned to receive articles from said flow;

detecting and maintaining a count of articles that are received in said at least one bin and have said predetermined color;

detecting articles in said flow, which do not have said predetermined color, and generating an out-of-color signal when said article is received in said at least one bin;

emptying said at least one bin into a first location when the count maintained in said detector is equal to said predetermined number; and emptying said at least one bin into a second location in response to generation of an out-of-color signal.

28. A counter unit for counting discrete articles which are within a predetermined size range, into lots having a predetermined number of articles, said counter unit comprising:

a receptacle having first and second bins for receiving said articles, each of said first and second bins having a first outlet gate for delivering articles from said bin to a package which is to receive one lot of said articles, and a second outlet gate for emptying articles from said bin into a container for holding groups of articles which include rejected articles, which have a size that falls outside said predetermined size range;

a supply of articles coupled to deliver a flow of articles separated by discrete intervals, to said receptacle;

a deflector gate for diverting said flow of articles into a selected one of said first and second bins and for changing the flow of articles from one of said first and second bins to the other of said first and second bins;

a detector unit arranged in said flow of articles upstream of said deflector gate, said detector unit detecting each article in said flow of articles as it enters said receptacle, determining its size, and generating an out-of-size signal whenever a detected article has a size which falls outside said predetermined size range; and a computer programmed to, maintain a count of articles detected by said detector unit, which articles have been received in a currently selected bin of said receptacle;

open said first outlet gate of said currently selected bin when a count of articles received therein equals said predetermined number, and thereafter cause said deflector gate to change said flow of articles to the other of said first and second bins; and open said second outlet gate of said currently selected bin in response to generation of an out of size signal from said detector unit.

* * * * *